US006851748B1

(12) United States Patent
Garrick

(10) Patent No.: US 6,851,748 B1
(45) Date of Patent: Feb. 8, 2005

(54) MULTIPLE CHAIR WORKSTATION

(76) Inventor: Mary C. Garrick, 117 Rosewood Ave., Lafayette, LA (US) 70506

( * ) Notice: Subject to any disclaimer, the term of this patent is extended or adjusted under 35 U.S.C. 154(b) by 8 days.

(21) Appl. No.: 10/254,629

(22) Filed: Sep. 24, 2002

(51) Int. Cl.[7] ..... A47C 15/00

(52) U.S. Cl. ..... 297/240; 297/241; 297/124; 297/257; 52/65; 52/31; 52/29; 248/429; 472/29; 472/36

(58) Field of Search ..... 248/429, 430; 297/135, 330, 173, 361, 327, 344.12, 344.23, 217.7, 240, 245, 241, 257, 242; 472/29, 36; 52/29, 7, 65, 31

(56) References Cited

U.S. PATENT DOCUMENTS

| | | | | | |
|---|---|---|---|---|---|
| 415,307 | A | | 11/1889 | Carrick | |
| 1,686,464 | A | * | 10/1928 | Perry | 297/241 |
| 2,498,550 | A | * | 2/1950 | Johnson et al. | 433/33 |
| 2,572,874 | A | | 10/1951 | MacKnight | |
| 2,836,224 | A | * | 5/1958 | Hicks | 297/241 |
| 3,953,091 | A | * | 4/1976 | Shults | 312/140.2 |
| 4,174,594 | A | * | 11/1979 | Panzini | 52/65 |
| 4,724,645 | A | * | 2/1988 | Pigout | 52/65 |
| 4,863,217 | A | * | 9/1989 | Fountain | 297/241 |
| 5,113,974 | A | * | 5/1992 | Vayda | 186/36 |
| 5,489,142 | A | * | 2/1996 | Mathieu | 297/327 |
| 5,496,090 | A | * | 3/1996 | Emmett et al. | 297/240 |
| 5,529,374 | A | * | 6/1996 | Wimberly, Jr. | 297/240 |
| 5,653,065 | A | * | 8/1997 | McIlwain | 52/65 |
| 5,755,160 | A | * | 5/1998 | Blufordcraving | 104/36 |
| 5,782,535 | A | * | 7/1998 | Lafer | 297/423.36 |
| 6,474,025 | B1 | * | 11/2002 | Faiks et al. | 52/36.1 |
| 2003/0141736 | A1 | * | 7/2003 | Chernoff et al. | 296/65.01 |

* cited by examiner

*Primary Examiner*—Peter M. Cuomo
*Assistant Examiner*—Erika Garrett
(74) *Attorney, Agent, or Firm*—Jesse D. Lambert

(57) ABSTRACT

A multiple chair workstation especially suitable for barbers, hair stylists, dentists, and the like. The workstation comprises a base having a centrally mounted client chair. A revolving floor surrounds the client chair, and an operator's chair is mounted on the revolving floor. The base has a vacuum system for collection of cut hair and other debris, along with air conditioning and lighting. Controls mounted in proximity to the operator chair permit control of the revolving floor and the vacuum and air conditioning. Both chairs may be vertically adjustable, as controlled from the operator chair. Additional controls may include a reclining back on the client and/or operator chair. Various utilitarian appendages such as footrests, armrests, tool trays, storage boxes and the like may be provided on the chairs.

9 Claims, 6 Drawing Sheets

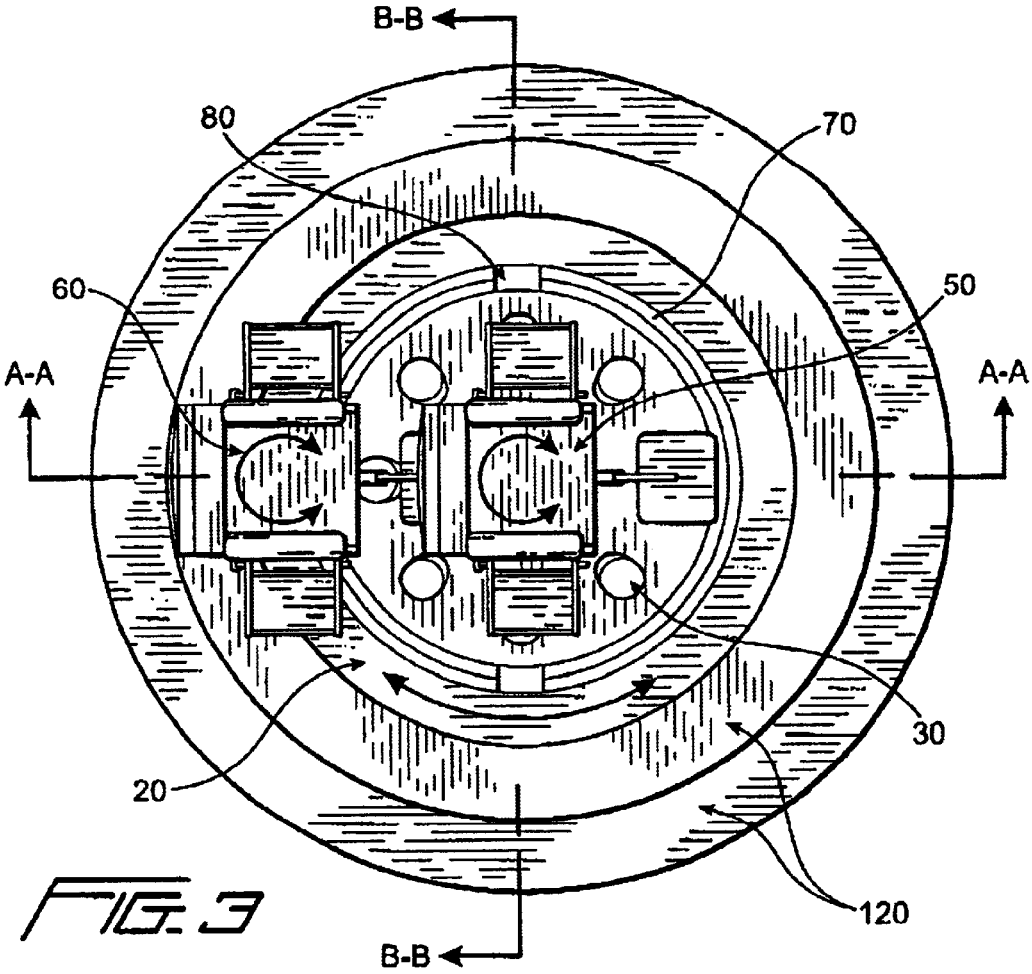
FIG. 3
FIG. 4
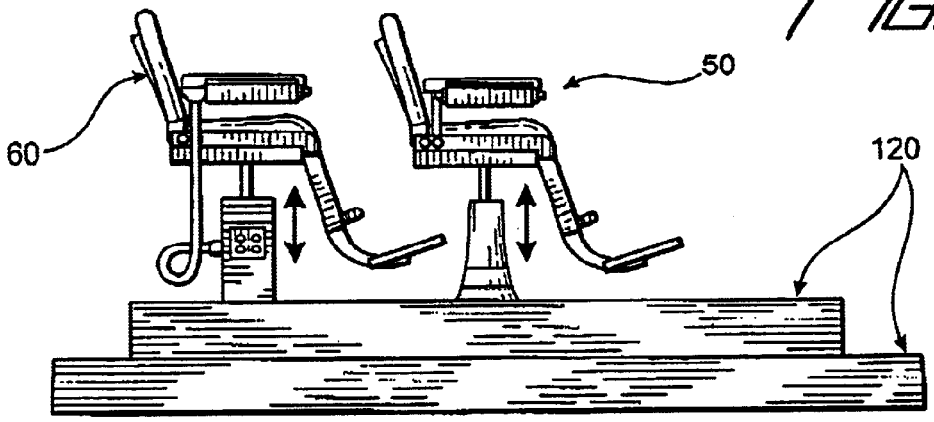

MULTIPLE CHAIR WORKSTATION

CROSS REFERENCE TO RELATED APPLICATIONS

Reference is made herein to Disclosure Document No. 480629, filed by Applicant.

BACKGROUND

1. Field of Invention

This invention relates to chairs and workstations commonly used in various professional services, by way of example specifically barbers, beauticians, stylists, dentists, etc.

2. Related Art

Chairs for clients to sit and/or recline in while various services are conducted on them are old in the art. For example, barbers and hair stylists have used such chairs for many years. Dentistry is another profession that uses such chairs. Usually, the chair in which the client sits is vertically adjustable so as to place the client in the proper position with respect to the operator (the term "operator" being used to refer to the barber, hair stylist, dentist, etc.). Often, a reclinable back on the chair permits the client to be at least partially reclined.

However, the prior art does not disclose a workstation having chairs for both the client and the operator, which additionally provides multiple positioning capabilities of the client in relation to the operator, and that has provisions for hair pickup, lighting, etc., operable from the operator's chair.

SUMMARY OF THE INVENTION

In essence, this invention comprises a multiple chair workstation, comprising a centrally mounted client chair and an operator's chair mounted on a revolving floor. The workstation further comprises a vacuum system for convenient pickup of hair and other debris, and a comprehensive lighting system. The various mechanisms are controllable from the operator's chair.

OBJECTS AND ADVANTAGES

Several objects and advantages of the invention are:

(a) a revolving carriage having an operator's chair mounted on a rotary platform, to revolve around a centrally mounted client chair, enabling an operator to sit while servicing a client.

(b) operator and client chairs having utilitarian appendages, such as footrests, armrests, tool trays, storage boxes, back pouch and remote control.

(c) a control mechanism with a multidimensional transmitter;

(d) a body carriage control comprising an integral circuitry system;

(e) a vacuum system that retrieve and collect hair and other debris;

(f) air conditioning air flow ventilation and outlets;

(g) a workstation comprising a plurality of luminations; and (h) a lighting system having full-reflector, insulated-lenses and a plurality of wattage accommodations.

DRAWING FIGURES

FIG. 3 is a top view of the invention.

FIG. 4 is a side view.

DETAILED DESCRIPTION OF SOME OF THE PRESENTLY PREFERRED EMBODIMENTS

While those having skill in the relevant art will recognize many different embodiments that may be made of the present invention, some of the presently preferred embodiments will now be described.

Figure 1:
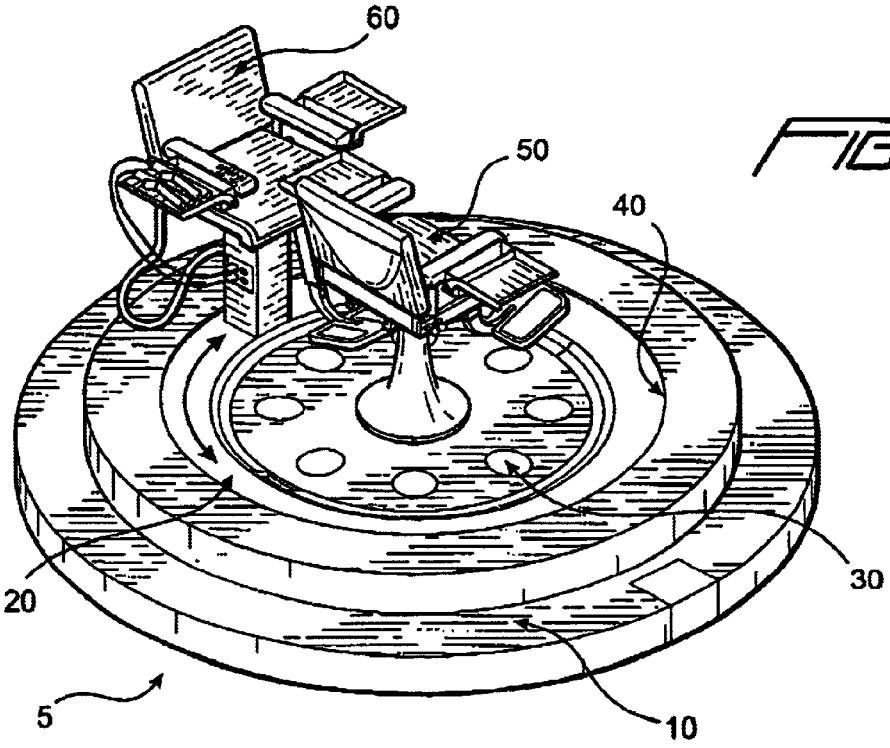
FIG. 1 shows a perspective view of the workstation of the present invention, including a paramount view of the chairs, revolving floor, base, air conditioning outlet, and lighting.

One preferred embodiment of the multiple chair workstation 5 is illustrated in FIG. 1. Workstation 5 has a round, circular base 10. While a number of dimensions are given in the following description, it is understood that same are given merely to describe the presently preferred embodiments, and not by way of limitation. Base 10 may have a first and second level steps 120, the first step having a circumference of 18 feet and a height of 9 inches. A second level step having a circumference of 17 feet and a height of 7 inches comprises an air conditioning outlet 40, and an inner ring which comprises a revolving floor 20. Operator chair 60 is mounted on revolving floor 20. Client chair 50 is centrally mounted on base 10. Both the client and operator chairs have similar dimensions, by way of example a seat 15" width×3" height, and a back 24" height×15" width. Placement of operator chair 60 in relation to client chair 50 permits the operator to be seated in operator chair 60, while carrying out the desired services on the client.

Figure 2:
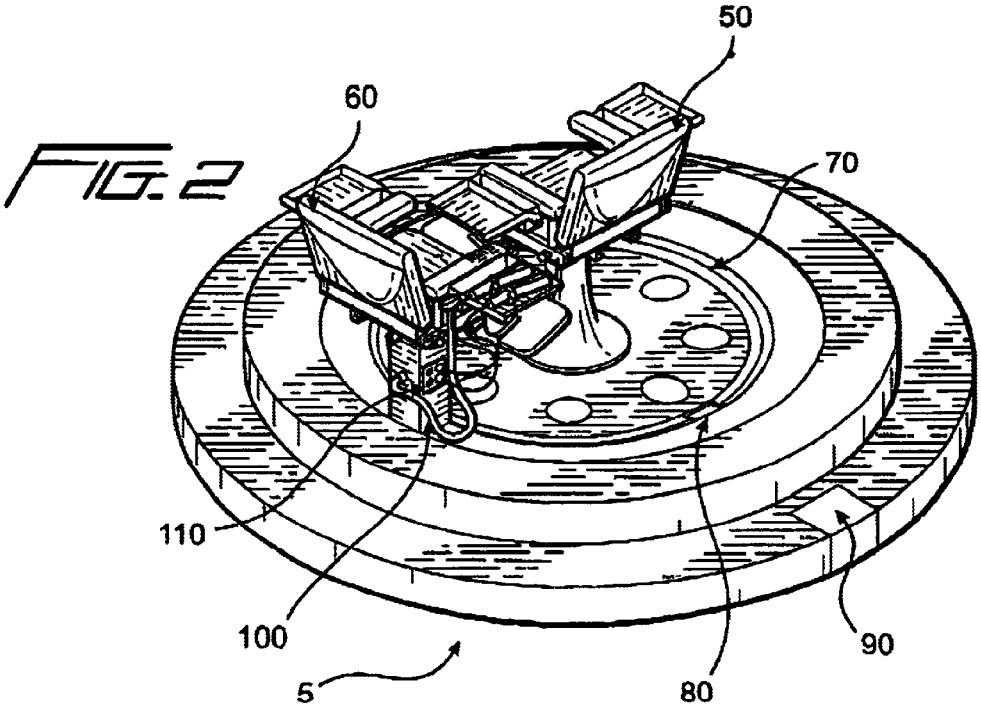
FIG. 2 shows another perspective view of the present invention, showing the operator chair, a vacuum retrieval access, and the hair/debris collection system.

A perspective view of operator chair 60 in FIG. 2 shows a vacuum system in base 10, comprising a hair vacuum station 80 and hair collection trough 70. Cleanout of the vacuum system is provided via vacuum station access 90. A vacuum unit comprising a hose 100 extends from the base of operator chair 60.

Lighting 30 is provided on revolving floor 20.

A detailed top or plan view is shown in FIG. 3. Workstation 5 comprises steps 120, revolving floor 20, hair collection trough 70, hair vacuum station 80, lighting 30, client chair 50 and operator chair 60. It is to be understood that references herein to "hair vacuum" and the like include other debris besides cut hair.

Preferred dimensions for the workstation include the base with a combined diameter of 18 feet. Each level is 7" in height. Level one has a 10" wide ledge at its base.

A side view of the Solar Workstation is shown in FIG. 4.

Figure 5:
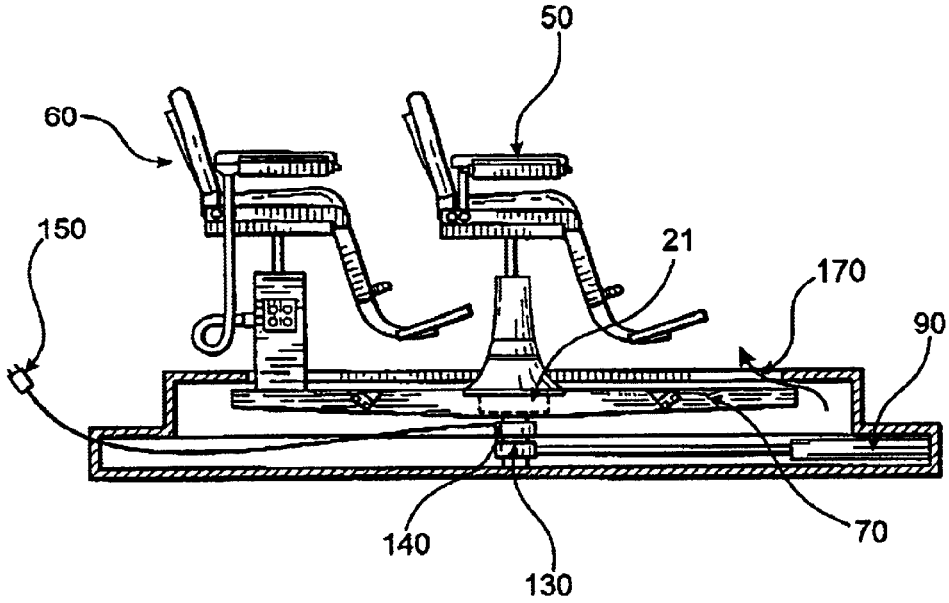
FIG. 5 shows a side view in partial cross section.
Figure 6:
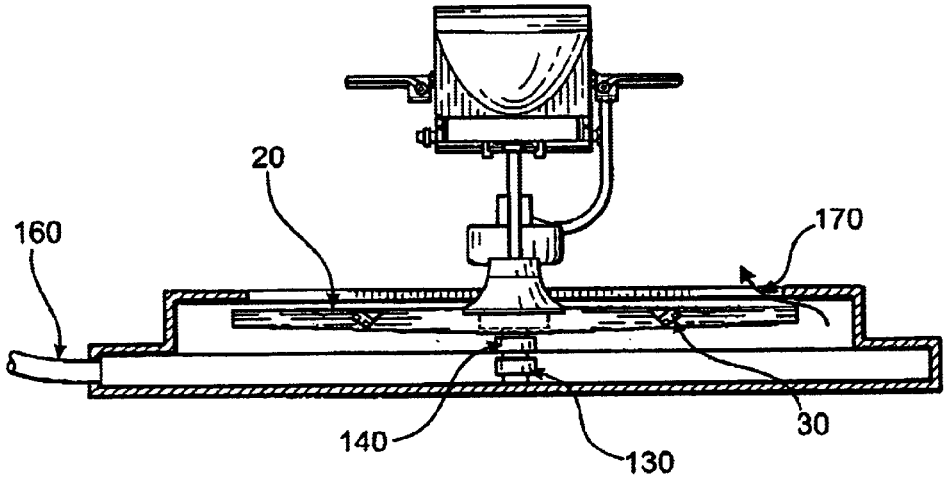
FIG. 6 is another side view in partial cross section.
Figure 7:
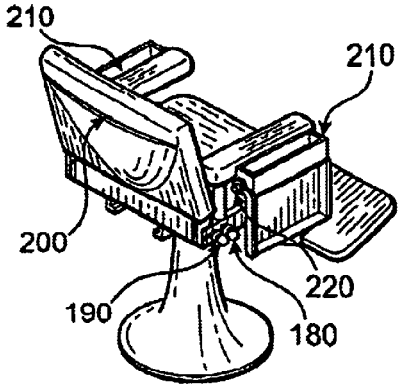
FIGS. 7–15 are various views of the chairs of the present invention.

FIG. 5 is a side view in partial cross section. A transmission system comprises rotary joint 130, which drives revolving floor 20. Revolving floor 20 may be powered by an electrically powered rotary drive means 21, such as electric motors or other suitable means known in the art, and controlled by controls 251. Workstation 5 further comprises vacuum source 90, hair trough 70, electrical rotary joint 140, air conditioning power cord 150, air conditioning flow outlet 160, and a revolving floor drive joint 171.

A client chair 50 shown in detail in FIGS. 7–12. Both client chair 50 and operator chair 60 comprise vertical adjusting means well known in the art, which may be mechanical, hydraulic or a combination thereof. Client chair 50 comprises a number of features. It is understood that operator chair 60 also comprises these described features. A pivot control lever 180 is attached to a side rail of chair seat. Control lever 180 adjusts chair arms inward and outward. A recline control lever 190 is also attached to side rail of chair seat it enables chair back to recline. A storage pouch 200 is mounted on back of client chair 50 and operator chair 60. Both chairs preferably have dimensions of approximately 36" in height and 15" in width. Other utilitarian appendages of client chair 50 and operator chair 60 are storage boxes 210 preferably having dimensions of 12" in length by 4" in width by 6" in depth. Trays 300 having exemplary dimensions of 12" in length by 8" in width by 6" in depth are provided.

Figure 8:
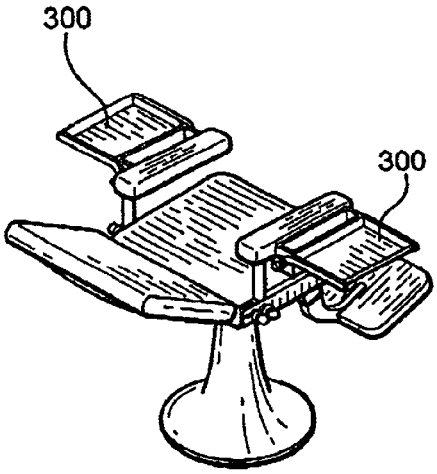

A closer up view of client chair 50 is shown in FIG. 8. Both client chair 50 and operator chair 60 comprise a generally bell shaped base. In addition to the vertical adjustments previously described, rotary adjusting means, which may be hydraulic or mechanical, driven by electric motors or other well known means, are provided.

Figure 9:
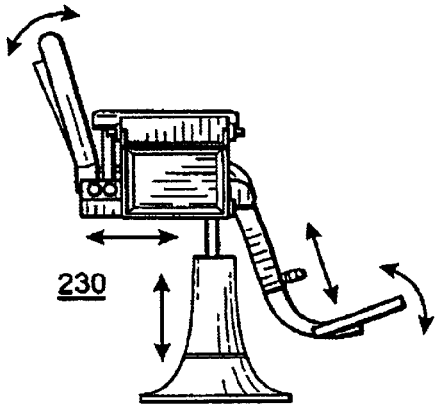
Figure 10:
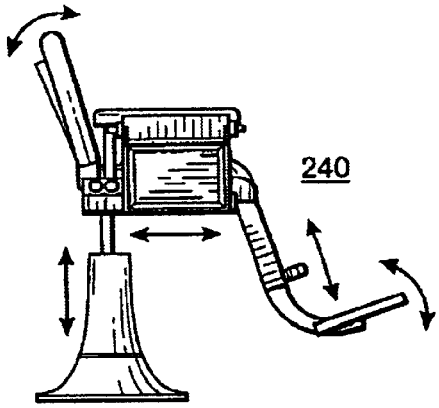
Figure 11:
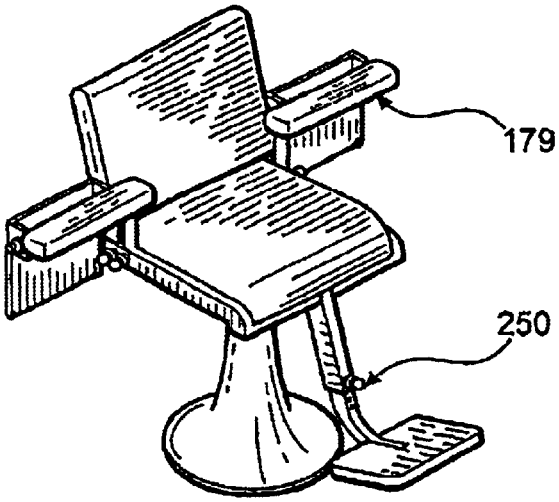
Figure 12:
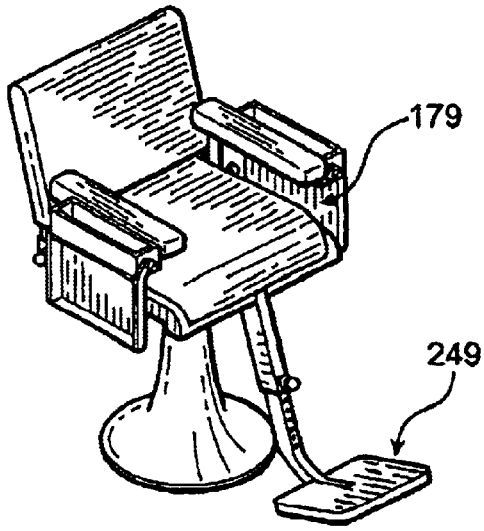

A client chair 50 in FIG. 9 in advanced backward position 230. A detailed view FIG. 10 shows a client chair 50 in forward directional movements advanced forward 240. Client chair 50 in FIG. 11 shows various positions of armrest and footrest.

Figure 13:
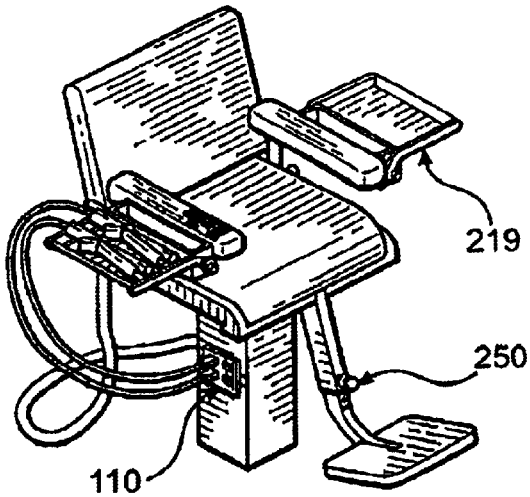
Figure 14:
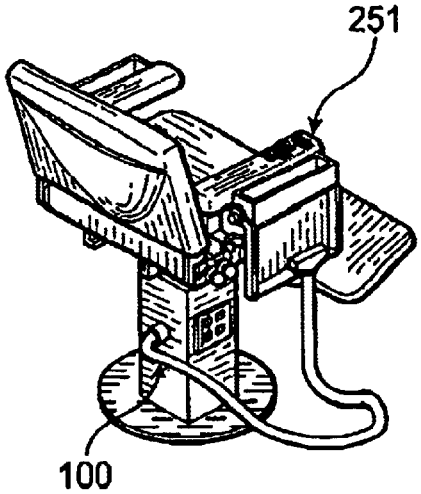
Figure 15:
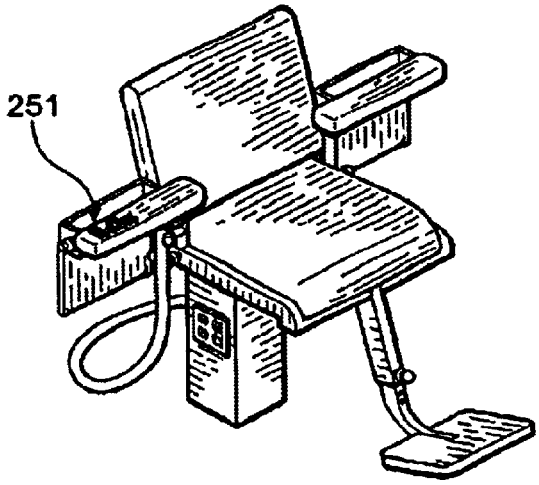
Figure 16:
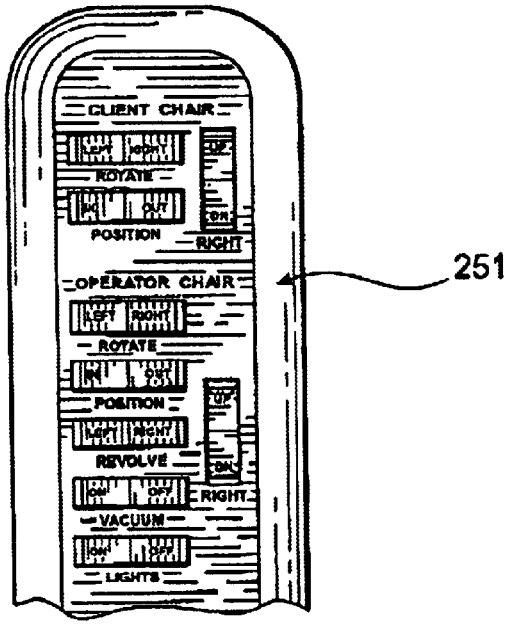
FIG. 16 shows one embodiment of the controls, preferably mounted in operable proximity to the operator chair.

FIGS. 13–15 are several views of operator chair 60. Operator chair 60 comprises trays 219, footrest 250, electrical a/c outlet 110, and controls 251. FIG. 16 is a detailed view of controls 251. Preferably, controls 251 comprise controls well known in the art to control revolving floor 20, vertical adjustments of both client chair 50 and operator chair 60, rotation of both client chair 50 and operator chair 60, reclining of both client chair 50 and operator chair 60, vacuum system, and lights 30.

In use, a client is seated in client chair 50. Operator preferably sits in operator chair 60. With controls 251, with wiring, etc. well known in the art, the operator is able to vertically control both chairs. The operator can additionally control the reclining of the client in client chair 50, and control revolving floor 20 to control his or her positioning in relation to client chair 50.

CONCLUSION, RAMIFICATION AND SCOPE

Accordingly, the present workstation has the capacity to facilitate an operator's job, giving total control and the convenience and safety of sitting while servicing a client. The workstation gives an operator complete accessibility to the client and trade tools while working in a safe workstation.

The workstation of the present invention is also adapted to permit the handicapped to succeed in various services trades, for example those of barber, beautician, stylist, dentist, physician, etc., safely and professionally.

The workstation of the present invention is also equipped with lights, air and vacuum. Furthermore, the workstation has the additional advantages

- a base having a central revolving floor surrounding a centrally mounted client chair;
- an operator chair mounted on the revolving floor, which revolves around the client chair, facilitating complete accessibility to the client;
- an operator/client chair arrangement that enables an operator to sit while servicing a client;
- operator and client chairs comprising utilitarian appendages, including footrests, armrests, tool trays, storage boxes, back pouches and remote control;
- a control mechanism with a multi-dimensional transmitter;
- a body carriage control which consists of an integral circuitry system;
- a vacuum system for the retrieval and collection of hair debris;
- a combination of air conditioning air flow and ventilation outlets;
- a lighting system having safety features comprising of insulated lenses and plurality of wattage accommodations;

Although the description above contains many specificities, these should not be construed as limiting the scope of the invention but as merely providing illustrations of the presently preferred embodiments of this invention. For example, the workstation can have other shapes, such as square, oblong, round, oval, rectangular, etc.

Thus the scope of the invention should be determined by the appended claims and their legal equivalents, rather than by the examples given.

I claim:

1. A workstation for accommodating personal services operators and clients, comprising:

a) a base comprising a center chair mount surrounded by a revolvable floor portion and lighting outlets disposed on said revolvable floor portion;

b) a client chair disposed on said center chair mount, said client chair comprising a reclining back and a foot rest; and c) an operator chair disposed on said revolving floor portion and in operative relationship to said client chair, whereby said operator chair revolves around said client chair with revolution of said revolving floor portion, said operator chair having at least one tool tray attached thereto and pivotable between a horizontal and a vertical position, and d) an electrically powered rotary drive means coupled to said revolvable floor portion, and controls disposed proximal said operator chair for controlling said rotary drive means.

2. The workstation of claim 1, wherein said base is hollow and comprises an air conditioning inlet and an air conditioning outlet, and further comprising an air flow source coupled to said inlet.

3. The workstation of claim 2, further comprising a vacuum inlet disposed on said revolving floor portion, and a vacuum air source fluidly connected to said vacuum inlet, whereby materials falling upon said revolving floor portion are at least partially moved into said vacuum inlet by an air flow induced by said vacuum air source.

4. The workstation of claim 3, further comprising controls mounted proximal to said operator chair for controlling said air flow source and said vacuum air source.

5. The workstation of claim 1, wherein said client chair comprises a powered, vertically telescopic base, said client chair is mounted on said base via a powered rotary swivel, and further comprising controls mounted proximal said operator chair for controlling said telescopic base upwardly and downwardly and for controlling rotation of said client chair.

6. The workstation of claim 3, wherein said client chair comprises a powered, vertically telescopic base, said client chair is mounted on said base via a powered rotary swivel, and further comprising controls mounted proximal said operator chair for controlling said telescopic base upwardly and downwardly and for controlling rotation of said client chair.

7. The workstation of claim 1, wherein said operator chair comprises a powered, vertically telescopic base, said operator chair is mounted on said base via a powered rotary swivel, and further comprising controls mounted proximal said operator chair for controlling said telescopic base upwardly and downwardly and for controlling rotation of said operator chair.

8. The workstation of claim 5, wherein said operator chair comprises a powered, vertically telescopic base, said operator chair is mounted on said base via a powered rotary swivel, and further comprising controls mounted proximal said operator chair for controlling said telescopic base upwardly and downwardly and for controlling rotation of said operator chair.

9. The workstation of claim 6, wherein said operator chair comprises a powered, vertically telescopic base, said operator chair is mounted on said base via a powered rotary swivel, and further comprising controls mounted proximal said operator chair for controlling said telescopic base upwardly and downwardly and for controlling rotation of said operator chair.

* * * * *